United States Patent [19]

Vallières

[11] Patent Number: 4,713,895

[45] Date of Patent: Dec. 22, 1987

[54] SPORTS SHOE COVER

[76] Inventor: François Vallières, 545 Poulin, Thetford Mines, Quebec, Canada, G6G 4T8

[21] Appl. No.: 883,370

[22] Filed: Jul. 8, 1986

[51] Int. Cl.[4] ..... A43B 3/02; A43B 3/00

[52] U.S. Cl. ..... 36/1.5; 36/2 R; 36/7.1 R

[58] Field of Search ..... 36/1.5, 2 R, 2 A, 2 B, 36/101, 114, 136, 132, 7.1 R, 7.2, 72 R; 2/DIG. 6, 22, 23

[56] References Cited

U.S. PATENT DOCUMENTS

| | | | |
|---|---|---|---|
| 1,097,354 | 5/1914 | Outerbridge, Jr. | 36/72 R |
| 2,099,476 | 11/1937 | Glowka | 36/2 R |
| 2,145,061 | 1/1939 | Stuart | 36/2 R |
| 2,420,618 | 5/1947 | Rabinovitz | 36/72 R |
| 2,872,745 | 2/1959 | Finegan | 36/2 R |
| 3,003,261 | 10/1961 | Graham et al. | 36/2 R |
| 3,087,260 | 4/1963 | Hudon | 36/2 R |
| 3,153,864 | 10/1964 | Brewer | 2/22 |
| 4,300,294 | 11/1981 | Riecken | 36/101 |

FOREIGN PATENT DOCUMENTS

| | | | |
|---|---|---|---|
| 636475 | 4/1928 | France | 36/2 R |
| 20252 | 9/1915 | United Kingdom | 36/2 R |
| 316065 | 7/1929 | United Kingdom | 36/1.5 |

*Primary Examiner*—Werner H. Schroeder
*Assistant Examiner*—Steven N. Meyers
*Attorney, Agent, or Firm*—Thomas J. Greer, Jr.

[57] ABSTRACT

A gaiter for sports shoes having a first flexible sheet portion adapted to completely cover the upper and heel of a sports shoe and a second flexible sheet portion adapted to cover the ankle and lower calf of the wearer. A first hook and pile type fastener tape is adapted to be fixed in spaced-apart areas on the sides of the heel and sole of the sports shoe, and a cooperating second hook and pile type fastener tape is fixed to the lower margin of the first sheet member at spaced-apart locations for attachment to the first fastener tape, whereby ventilation openings are provided between the spaced-apart fastening tapes. Further ventilation openings are provided in the protector. Fastening means are provided for allowing entry and removal of said protector gaiter.

5 Claims, 6 Drawing Figures

SPORTS SHOE COVER

BACKGROUND OF THE INVENTION

1. Field of the Invention

The present invention relates to shoe protectors, and more particularly, to spats or gaiters for protecting sports shoes.

2. Description of the Prior Art

Gaiters were at one time very popular for protecting a person's shoes against dust and dirt before it was customary to cover streets and sidewalks with asphalt and concrete. Waterproof gaiters were also designed to protect shoes or boots against rain and mud. When designing waterproof gaiters, it was recognized that the lower portion of the gaiter should be maintained as close as possible against the sole and heel of the shoe in order to prevent water and mud from entering below the apron formed by the gaiter. U.S. Pat. No. 2,099,476, Nov. 16, 1937, and U.S. Pat. No. 2,151,350, Mar. 21, 1939, both issued to M. Glowka for a waterproof spat, illustrate attempts to secure the lower edge of the spat to the sole and heel. Other such attempts are described in U.S. Pat. No. 2,235,490, issued Mar. 18, 1941 to S. Saksa, and U.S. Pat. No. 3,477,147, issued Nov. 11, 1969 to W. Bauer. The spats of the Glowka patents utilize tabs or hooks attached to the lower edge of the spat while the Bauer and Saksa patents describe an arrangement with zippers, having one element of the zipper fixed to the sole and/or heel.

Much development has been made in recent years with respect to sports shoes, such as jogging shoes. These shoes have evolved to the stage where the uppers, particularly on running shoes, are a very loose weave of large yarn in order to provide ample ventilation. Runners, on the other hand, run in any weather. Running gear has been developed for these climatic variations which includes complete foul weather suits. However, nothing has been developed for protecting the feet, particularly when wearing modern running shoes in foul weather.

SUMMARY OF THE INVENTION

It is an aim of the present invention to provide a sports shoe protector against foul weather, and particularly a protector which will allow sufficient ventilation for the feet.

A construction in accordance with the present invention comprises a gaiter for sports shoes having a first flexible sheet portion adapted to completely cover the upper and heel of a sports shoe and a second flexible sheet portion adapted to cover the ankle and lower calf of the wearer. A first hook and pile type fastener tape is adapted to be fixed in spaced-apart areas on the sides of the heel and sole of the sports shoe, and a cooperating second hook and pile type fastener tape is fixed to the lower margin of the first sheet member at spaced-apart locations for attachment to the first fastener tape, whereby ventilation openings are provided between the spaced-apart fastening tapes. Further ventilation openings are provided in the protector. Fastening means are provided for allowing entry and removal of said protector gaiter.

The hook and pile type fastener tape is of the type better known as "Velcro", a trade mark of Velcro U.S.A. Inc.

The sheet material is preferably waterproof, and the second portion overlaps the first portion such that ventilation openings can be provided between points of attachment between the first and second members such that the ventilation openings remain protected from rain.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figures 1, 2:
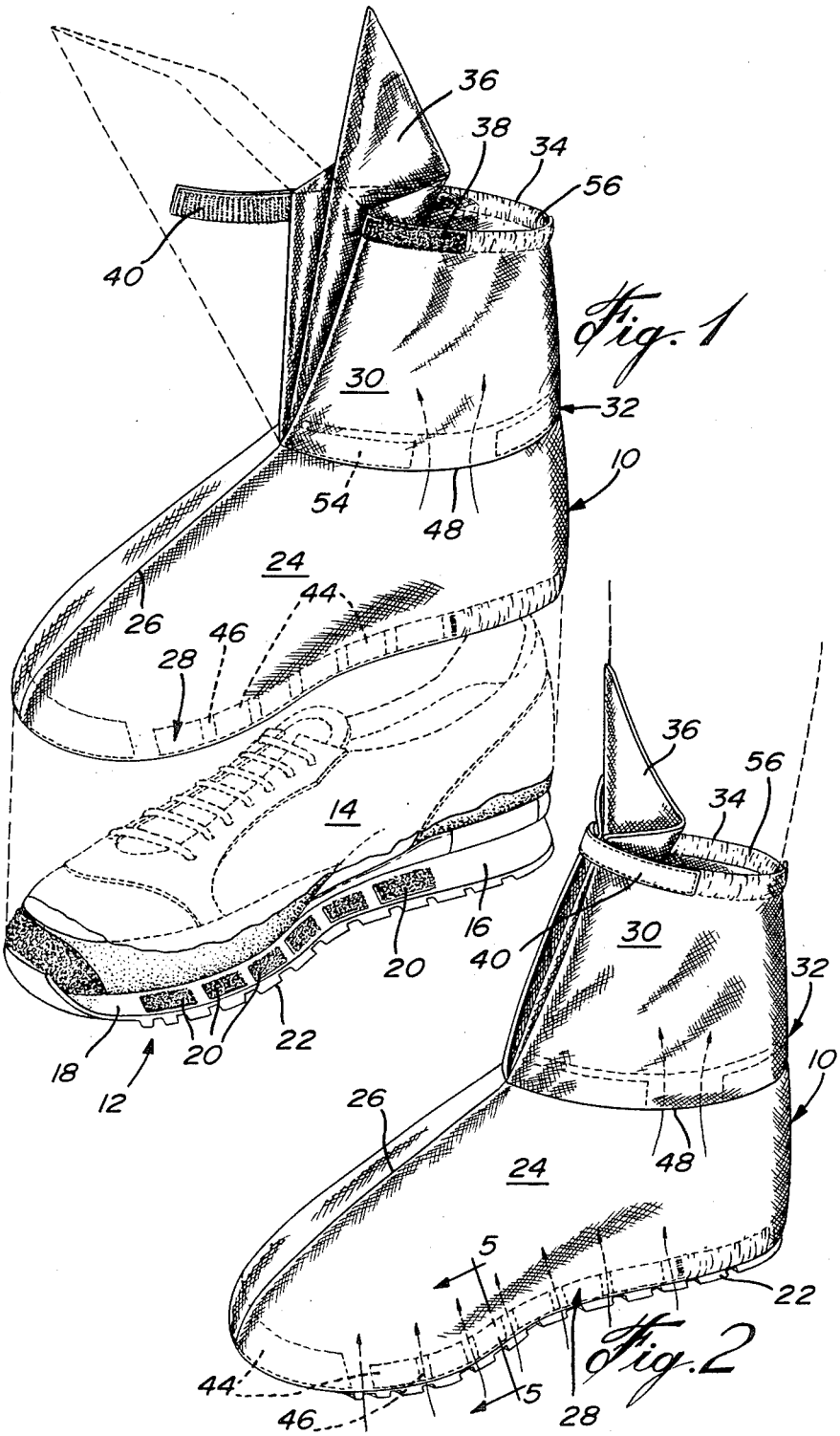
FIG. 1 is a perspective exploded view showing a sports shoe gaiter in accordance with the present invention adapted to be used on a running shoe.
FIG. 2 is a perspective view of the gaiter in position on the running shoe.
Figure 3:
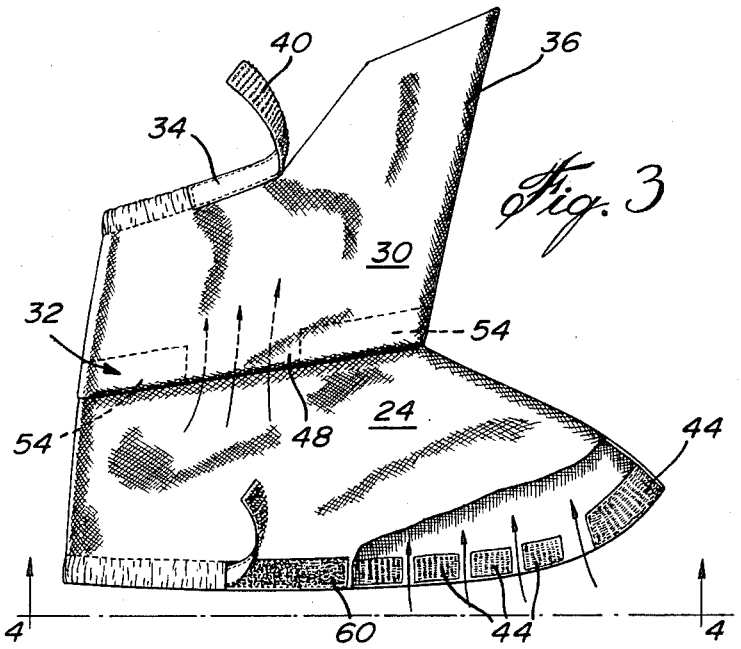
FIG. 3 is a side elevation, partly cut away, of a gaiter in accordance with FIG. 1.
Figure 4:
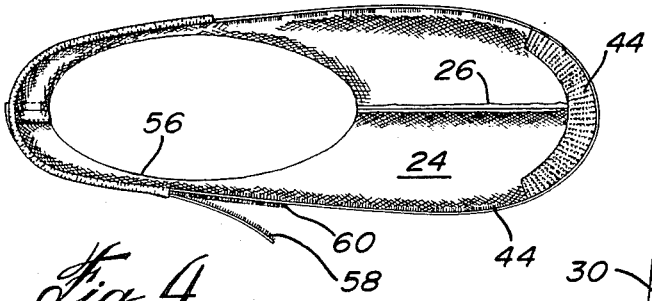
FIG. 4 is a bottom plan view thereof taken along line 4—4 of FIG. 3.
Figure 5:
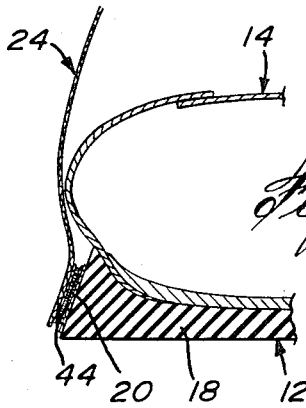
FIG. 5 is a fragmentary cross-section taken along line 5—5 of FIG. 2.

Referring now to the drawings, and particularly to FIGS. 1 and 2, there is shown a foul weather gaiter 10 adapted to be attached to a running shoe 12. The running shoe 12 includes an upper 14, a sole 18, and a heel 16.

Pieces of Velcro tape are placed on the side of the sole and the heel at 20 and are spaced apart one from the other. The gaiter 10 includes a first apron 24 adapted to fit the contours of the upper 14 of a typical running shoe. The apron 24 is made in one piece and stitched at a seam 26. The material forming the apron 24 can be a waterproof or at least water resistant nylon fabric.

Velcro strips 44 are placed on the inner lower margin 28 of the apron 24 and are adapted to match with the Velcro strips 20 placed on the sole and heel 18 and 16 of the shoe 14. These spaced-apart Velcro strips are arranged such as to allow ventilation passages 46 between the Velcro strips when the gaiter 10 is on the shoe.

Figure 6:
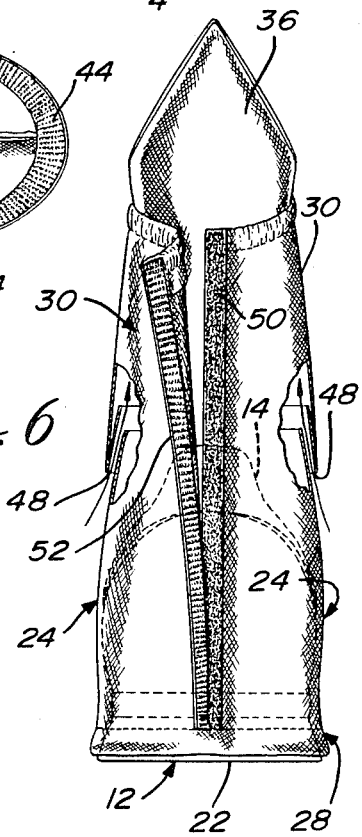
FIG. 6 is a rear elevation of the gaiter.

An upper portion 30, which will be referred to as the ankle cuff 30, is stitched to the upper edges of the apron 24 at stitching areas 54 along band 32, leaving openings 48 as shown in FIG. 6. The material of the ankle cuff 30 is the same as the material forming the apron 24 and can be folded over as illustrated in FIG. 6 to form the overlapping marginal portion forming the openings 48.

The ankle cuff 30 includes an upper margin 34 with a Velcro strip 38 and companion tab 40. The upper margin 34 defines a leg opening 56. The ankle cuff 30 includes a pleated portion 36 which allows the cuff 30 to expand when it is being removed or fitted to the leg of the wearer. Thus, the size of the opening 56 can vary depending on the size of the wearer's leg and the tightness required. The pleated portion 36 provides for the expansion and the Velcro tab 40 allows for the adjustable sizing thereof.

The apron 24 is fitted to surround the heel of the shoe 12, and as shown in FIG. 6, both the apron and the cuff portion are provided with an opening which can be closed by means of Velcro strip fasteners 50 and 52. Thus, when it is required to put on the gaiter, the wearer's foot, including the shoe 12, is passed through the opening 56 which is opened by means of the fasteners 50 and 52. Once the foot and shoe 12 are within the gaiter 10, the Velcro strips 44 along the margin 28 are located to coincide with the Velcro strips 20 and are pressed thereon in order to fasten the gaiter to the shoe. The gaiter 10 is then closed by means of Velcro fasteners 50 and 52. The opening 56 is then sized and the fastener tab 40 is closed on the Velcro strip 38. Thus, a runner can then run in complete comfort in foul weather conditions but with proper ventilation being provided by means of the passages 46 between the Velcro strips 20 and 44 as well as passages 48 at the band 32.

The ventilation openings 48 can be provided in other areas, on the apron 24 for instance. In such cases, a seam similar to band 32 would be provided in order to form the apron.

It is seen that the distribution of the first and second Velcro strips over the toe area and along the sides of the sole of the shoe also serve to inhibit flapping of the gaiter relative to the shoe during running.

I claim:

1. A protective gaiter for sports shoes comprising a first flexible sheet portion completely covering the upper and heel of the sports shoe, and a second flexible sheet portion covering the ankle and lower calfs of a wearer, a first hook and pile type fastener tape fixed in spaced-apart areas about the periphery of the sole of the sports shoe, and cooperating second hook and pile type fastener tape fixed to the lower margin of the first sheet portion at spaced-apart locations for attachment to the first fastener tape, said fastener tapes being distributed over the toe area and along the sides of the sole of the shoe at a plurality of locations, the first and second tapes cooperating to retain the gaiter on the shoe to thereby inhibit flapping of the gaiter relative to the shoe during running, whereby ventilation openings are provided between the spaced-apart fastening tapes.

2. A gaiter as defined in claim 1, wherein the flexible sheet material is waterproof nylon.

3. A gaiter as defined in claim 1, wherein the second sheet portion overlaps the first sheet portion and ventilation openings are provided between the first and second sheet portions under the overlapped portion.

4. A gaiter as defined in claim 1, wherein the closure means for providing entry and removal of said protector are associated with overlapping flaps of the first and second sheet portions at the rear thereof for rear entry into the gaiter.

5. A gaiter as defined in claim 1, wherein the second sheet portion is provided with expanding pleats and a fastening device to allow adjustable sizing of the opening defined by the second sheet portion.

* * * * *

UNITED STATES PATENT AND TRADEMARK OFFICE

CERTIFICATE OF CORRECTION

PATENT NO. : 4,713,895

DATED : Dec. 22, 1987

INVENTOR(S) : Francois Vallieres

It is certified that error appears in the above-identified patent and that said Letters Patent is hereby corrected as shown below:

On the Title Page, add Item [73]

Assignee: Andrew Jacobs
24 Holtham Place
Hampstead
Quebec, Canada H3X 3N5

Assignor assigns a 1/2 interest

Signed and Sealed this

Thirty-first Day of May, 1988

*Attest:*

DONALD J. QUIGG

*Attesting Officer*

*Commissioner of Patents and Trademarks*